US006859981B2

(12) United States Patent
Hsiao

(10) Patent No.: US 6,859,981 B2
(45) Date of Patent: Mar. 1, 2005

(54) FINE ADJUSTABLE SLIDING BUCKLE

(75) Inventor: Hsiung-Ming Hsiao, Taoyuan (TW)

(73) Assignee: Taiwan Industrial Fastener Corporation, Taipei (TW)

( * ) Notice: Subject to any disclaimer, the term of this patent is extended or adjusted under 35 U.S.C. 154(b) by 0 days.

(21) Appl. No.: 10/689,705

(22) Filed: Oct. 22, 2003

(65) Prior Publication Data

US 2004/0148741 A1 Aug. 5, 2004

(30) Foreign Application Priority Data

Jan. 30, 2003 (TW) ..... 92201953 U

(51) Int. Cl.[7] ..... A43C 11/14
(52) U.S. Cl. ..... 24/68 SK
(58) Field of Search ..... 24/68 SK, 69 SK, 24/70 SK, 71 SK, 68 R, 70 ST, 69 ST, 71 ST, 68 A, 68 D, 68 E; 36/50.1, 50.5

(56) References Cited

U.S. PATENT DOCUMENTS 5,416,952 A * 5/1995 Dodge ..... 24/68 R
5,606,779 A * 3/1997 Lu ..... 24/68 SK
6,374,464 B1 * 4/2002 Lai ..... 24/68 SK
6,694,644 B2 * 2/2004 Haupt ..... 36/50.5
2001/0013157 A1 * 8/2001 Giancarlo ..... 24/71 SK

FOREIGN PATENT DOCUMENTS

DE 20002436 U1 * 7/2000 ..... A43C/11/00
EP 400213 A1 * 12/1990 ..... A43B/5/00
EP 572373 A1 * 12/1993 ..... A43C/11/14

* cited by examiner

*Primary Examiner*—James R. Brittain

(57) ABSTRACT

A fine adjustable sliding buckle is described. The fine sliding adjustable buckle has a base having two pairs of axial holes respectively for axially fitting the axles of the releasing plate and fine adjustment handle. The axles positioned on the two sides of the fine adjustment handle and the releasing plate are fitted in the axial holes on the same side of the base, and the handling portion of the fine adjustment handle has a receiving hole for receiving the releasing plate. Thus the fine adjustment handle and the releasing plate are positioned along the same direction and are positioned almost on the same plane to prevent accidental touch which would otherwise accidentally release the releasing plate from the base to loosen the adjustment belt. Thus, the fine adjustable sliding buckle of the present invention is easy to operate, safe and compact.

3 Claims, 9 Drawing Sheets

FINE ADJUSTABLE SLIDING BUCKLE

BACKGROUND OF THE INVENTION

1. The Field of the Invention

The present invention relates to a fine adjustable sliding buckle, and more particularly to a fine adjustable sliding buckle comprising a long base having a fine adjustment handle and a releasing plate along the same axial direction, wherein the releasing plate is received in a receiving hole of the fine adjustment handle as in an approximated phase, so that accidental pressing onto the releasing plate can be effective prevented and thus loosening off of the adjustable belt from the base can be effective prevented. Thus, easy operation, safe and fine size-adjustment can be effectively achieved.

2. Description of the Related Art

Securing buckles with the adjustable belt are commonly applied in shoes, roller skaters and alike. The securing buckle comprises a base, a releasing plate and an adjustable belt. The releasing plate is generally designed to be able to rotate for releasing from or buckling into the space between the protruded gears of the adjustable belt. Additionally, the buckle may also have a spring to aid for bouncing the releasing plate as it releases from the space between the protruded gears. However, such a design is complicated and difficult to assemble. Besides, because the adjustment belt is positioned within the releasing plate and the base, and therefore it is difficult to fine adjust the belt effectively through visual judgment and then rotating the releasing plate if the user wishes to adjust the length of the adjustment belt again. The user has to feel the belt then use hands to adjust thereof. When applying such a belt to shoes, the outward stress of the shoe makes the adjustment job even tougher. Therefore, how to improve the overall design and the adjustment manner to substantially achieve easy operation for the user and also reduce the manufacturing cost thereof is an important issue in the field.

Correspondingly, referring to FIGS. 8 and 9, the elevational view and exploded view of the conventional buckle, as shown, the buckle comprises an U-shaped base C that has two side plates with two pairs of axial holes C3 and C4. The axial holes C3 and C4 are for fitting the axles A1 and B1 formed on the two sides of the releasing plate A and the fine adjustment handle B, and further to fit the adjustment belt D into the button channel C1 and the track C2 of the base C. The feature of the above structure is that the fine adjustment handle B has a resilient arch-shaped resilient supporting plate B2 formed extending from the distal end of the inner side thereof, when rotating the fine adjustment handle B, the distal end of the resilient supporting plate B2 is vertically buckled into the space between the protruded gears D1 of the adjustment belt D, thus the adjustment belt D is moveable within the distance of a gear each time. When back the fine adjustment handle B is rotated, the arch-shaped of the resilient supporting plate B2 is resiliently deformed along the slope of the space between the protruded gears D1 of the adjustment belt D to return to the position.

The buckle depicted above has some fine adjustment function, easy assembly and easy operation. However, the releasing plate A and the fine adjustment handle B are positioned on the two sides of the base C, and therefore the overall space occupation is correspondingly larger. Thus, the application of such a buckle is limited, for example, for its application in a shoe, a bag, a backpack or other items, invariably requires the user to make some adjustment.

Besides, when using the fine adjustment handle B, the user may accidentally touch the releasing plate A releasing the adjustment belt D from the base C that would require unnecessary re-setting of the belt. If the user has already worn the shoe and the adjustment belt D is accidentally released from the base C through an accidental touch of the releasing plate A, it may hurt the user's ankle or trip the user while walking or running as the shoe is still fitted on the foot of the user. Therefore, the design of the above described conventional buckle still need to be improved for overcoming the above defects.

SUMMARY OF THE INVENTION

Accordingly, in the view of the foregoing, the present inventor makes a detailed study of related art to evaluate and consider, and uses years of accumulated experience in this field, and through several experiments, to create a new fine adjustable sliding buckle in order to overcome the above defects. The present invention provides a novel and cost effective fine adjustable sliding buckle.

According to an embodiment of the present invention, a fine adjustable sliding buckle is provided. The fine sliding adjustable buckle comprises a base having two pairs of axial holes respectively for axially fitting the axles of the releasing plate and fine adjustment handle. The axles positioned on the two sides of the fine adjustment handle and the releasing plate are fitted in the axial holes on the same side of the base, and the handling portion of the fine adjustment handle has a receiving through hole for receiving the releasing plate. Thus the fine adjustment handle and the releasing plate are positioned along the same direction and are positioned almost on the same plane to prevent accidental touch which would otherwise accidentally release the releasing plate from the base to loosen the adjustment belt. Thus, the fine adjustable sliding buckle of the present invention is easy to operate, safe and compact.

BRIEF DESCRIPTION OF THE DRAWINGS

For a more complete understanding of the present invention, reference will now be made to the following detailed description of preferred embodiments taken in conjunction with the accompanying drawings.

DETAILED DESCRIPTION OF PREFERRED EMBODIMENTS

Figure 1:
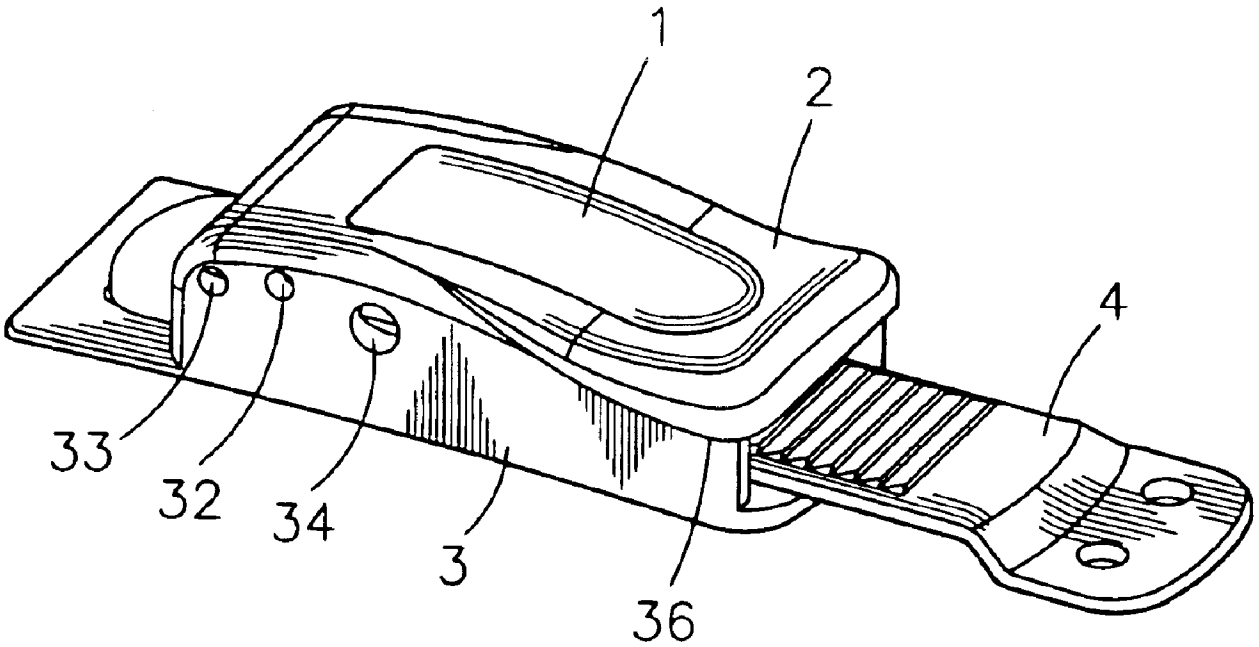
FIG. 1 is an elevational view of a fine adjustable sliding buckle according to a preferred embodiment of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
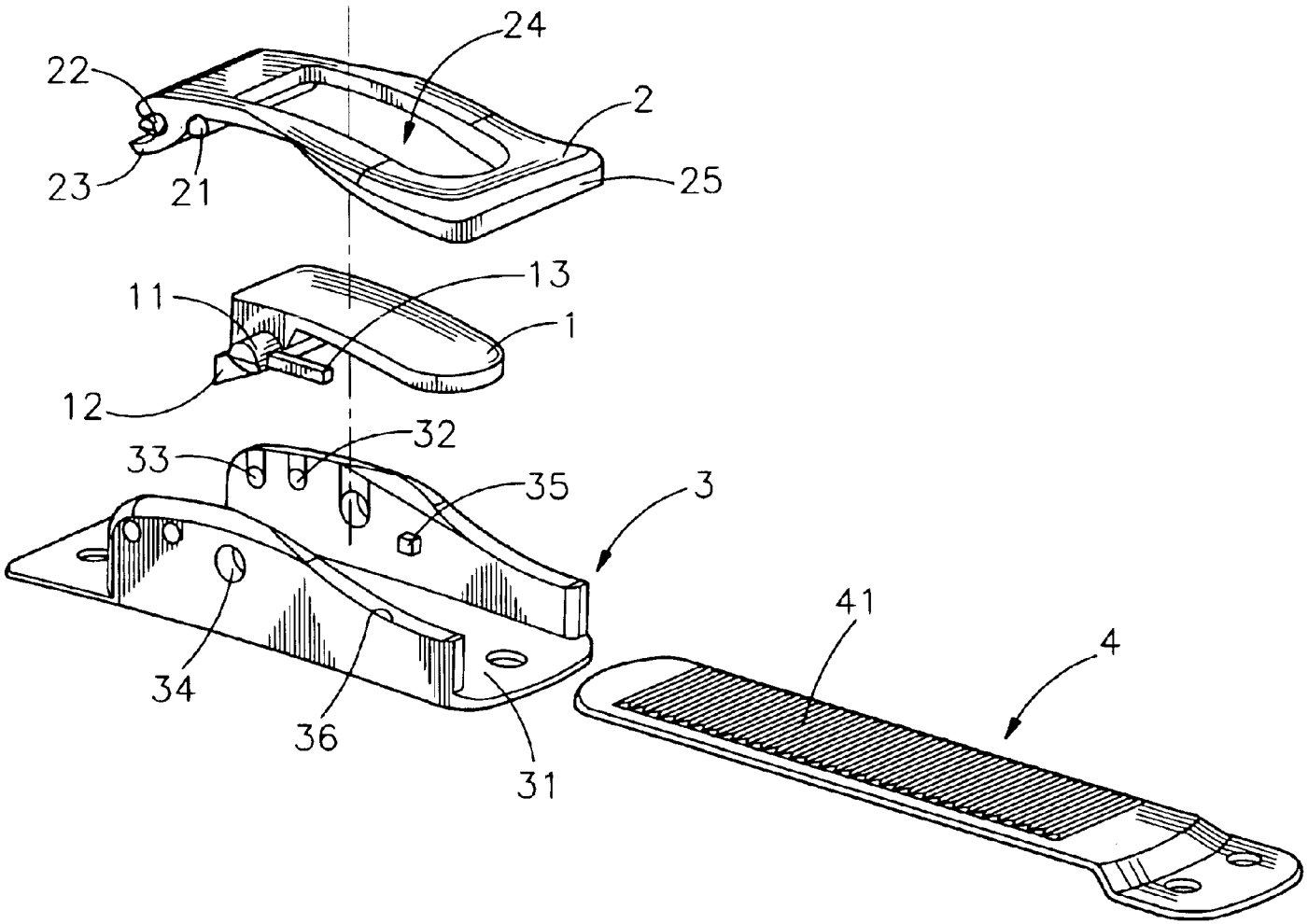
FIG. 2 is an exploded view of the fine adjustable sliding buckle according to a preferred embodiment of the present invention.
Figure 3:
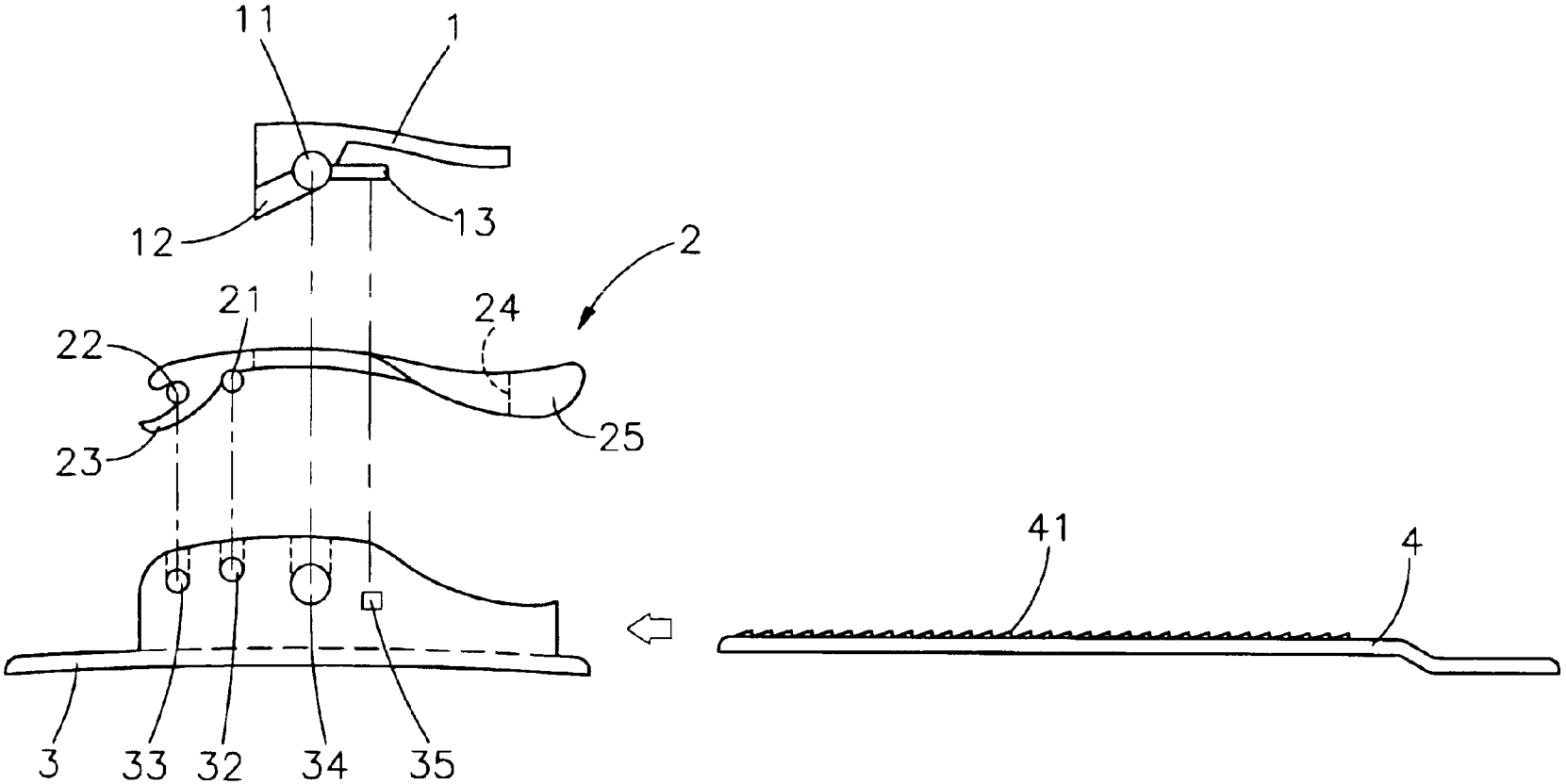
FIG. 3 is an explored side view of the fine adjustable sliding buckle according to a preferred embodiment of the present invention.

Referring to FIGS. 1, 2 and 3, the elevational view, the exploded view and the exploded side view of the fine adjustable sliding buckle according to a preferred embodiment of the present invention are illustrated. The fine adjustable sliding buckle comprises a releasing plate 1, a fine adjustment handle 2, a base 3 and an adjustment belt 4.

The releasing plate 1 is formed as an integral unit, and has a pair of corresponding axles 11 on each side. Two axles 11 are formed at a bottom side of a buckling portion 12 and a resilient plate 13 is formed at a backside of the axels 11.

The fine adjustment handle 2 is an arch-shaped plate and has a protruded point 21 on the two sides thereof. At the outer side of the protruded point 21 has two pair of corresponding axles 22, and the axles 22 have an arch-shaped resilient supporting plate 23 extending from the distal end of the fine adjustment handle 2. Additionally, the handling portion 25 of the fine adjustment handle 2 has an arched bottom face and a receiving hole 24 for receiving the releasing plate 1.

The base 3 is a long U-shape plate, which has a through channel 31 formed at a bottom part between the two sides. Axial holes 33 are correspondingly formed at the frontal side of rear sidewalls of the base 3, and securing holes 32, axial holes 34 and supporting block 35 formed respectively from the left to the right of the base 3. An arch portion 36 is formed at the top face of the two sidewalls of the base 3, wherein the arch portion 36 allows the arched bottom face of the handling portion 25 of the fine adjustment handle 2 to lean against a top face of the two sidewalls of the base 3.

Furthermore, the adjustment belt 4 is a long structure having a plurality of protruded gears 41 formed on the surface thereof.

To assemble the embodiment of the present invention, the two axles 22 of the fine adjustment handle 2 are fit into the two corresponding axial holes 33 of the base 3, and the protruded points 21 formed at the rear side of the axles 22 are buckled into the securing holes 32. Next, the two axles 11 of the releasing plate 1 are fit into the axial holes 34 of the base 3. The resilient plate 13 extending from the two axles 11 can support against the surface of the supporting block 35 of the base 3 and makes the releasing plate 1 to position in the receiving hole 24 of the fine adjustment handle 2 such that the releasing plate 1 is almost in the same plane of the fine adjustment handle 2. Thus, this arrangement allows the releasing plate 1 and the fine adjustment handle 2 to operate at the same side of the base 3. Furthermore, by pressing on the unsupported portion of the releasing plate 1, the adjustment belt 4 from the through channel 31 can be fit into the base 3.

Figure 4:
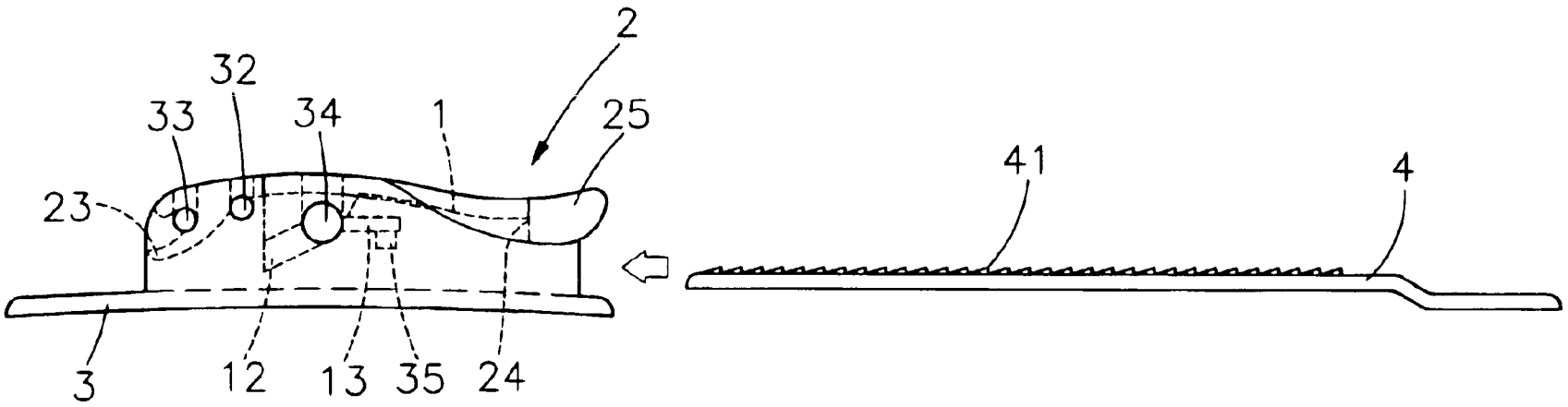
FIG. 4 is an explored side view of an adjustment belt and a base of the fine adjustable sliding buckle according to a preferred embodiment of the present invention.
Figure 5:
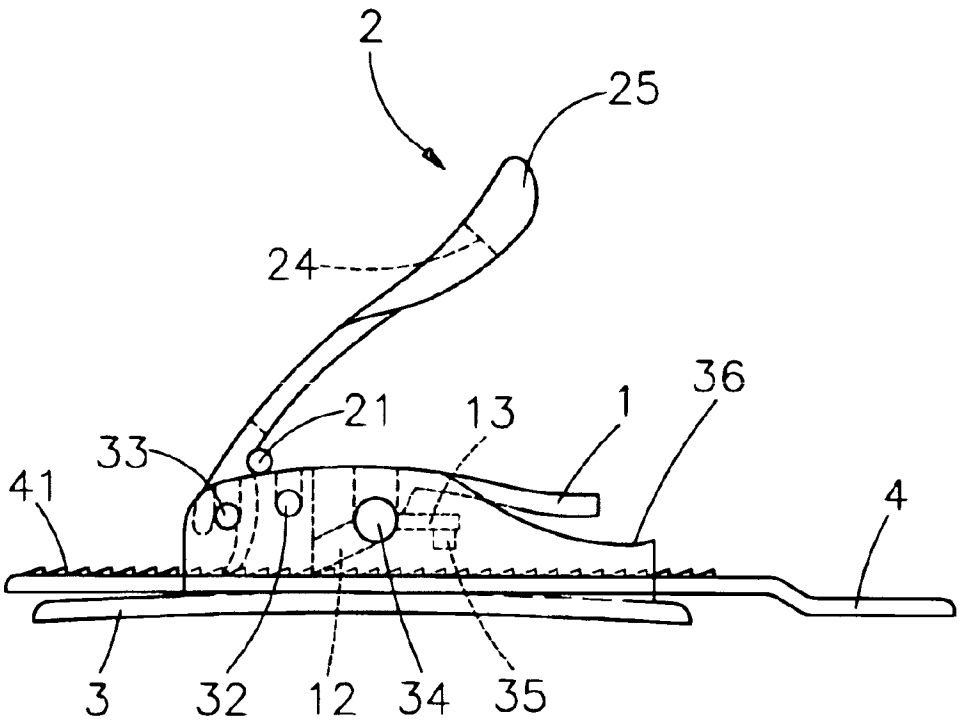
FIG. 5 is the side view of the fine adjustment handle during operation thereof of the fine adjustable sliding buckle according to a preferred embodiment of the present invention.
Figure 6:
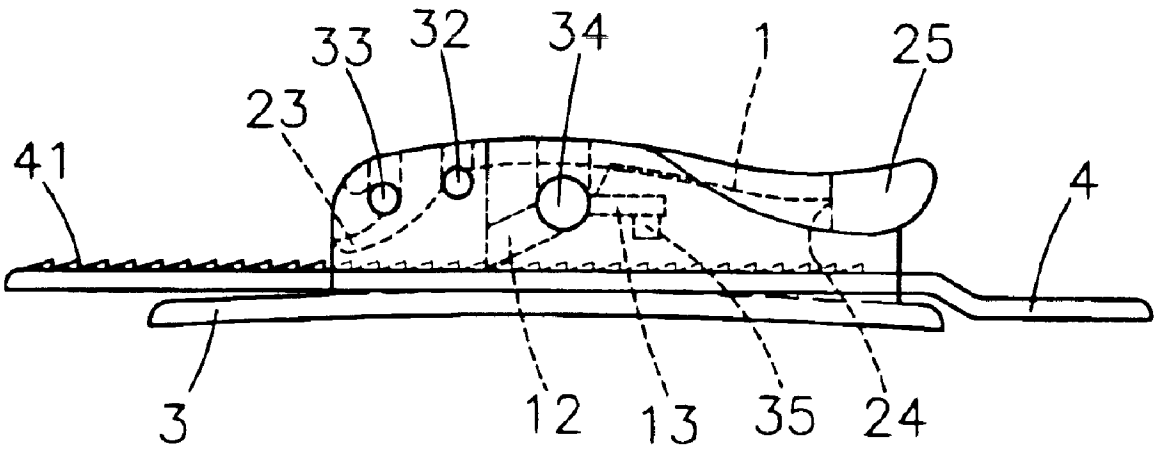
FIG. 6 is the side view of the adjustable belt of the present invention during the operation thereof to a certain position.
Figure 7:
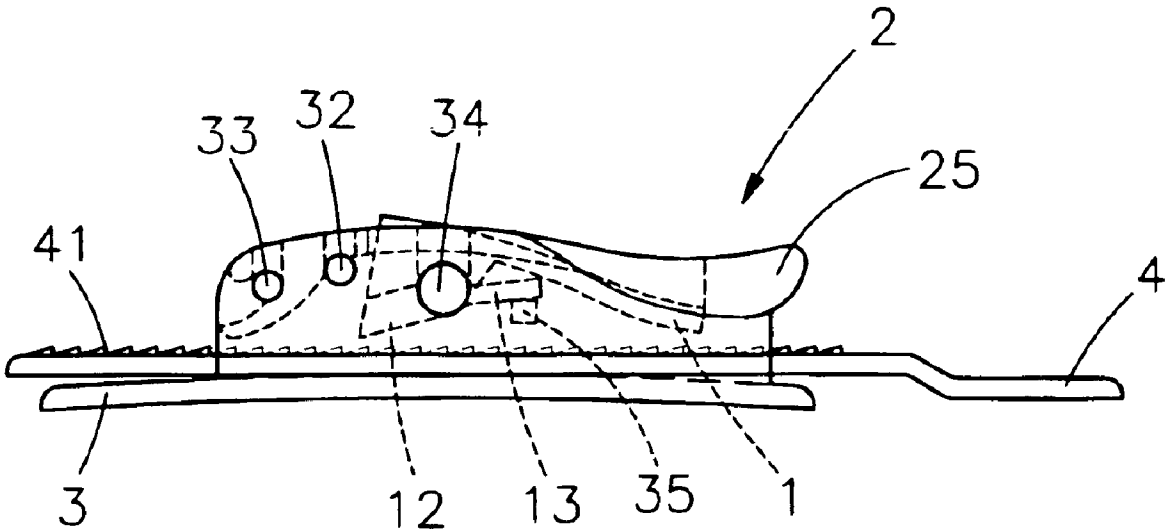
FIG. 7 is the side view of the motion of the releasing plate of the present invention.
Figure 8:
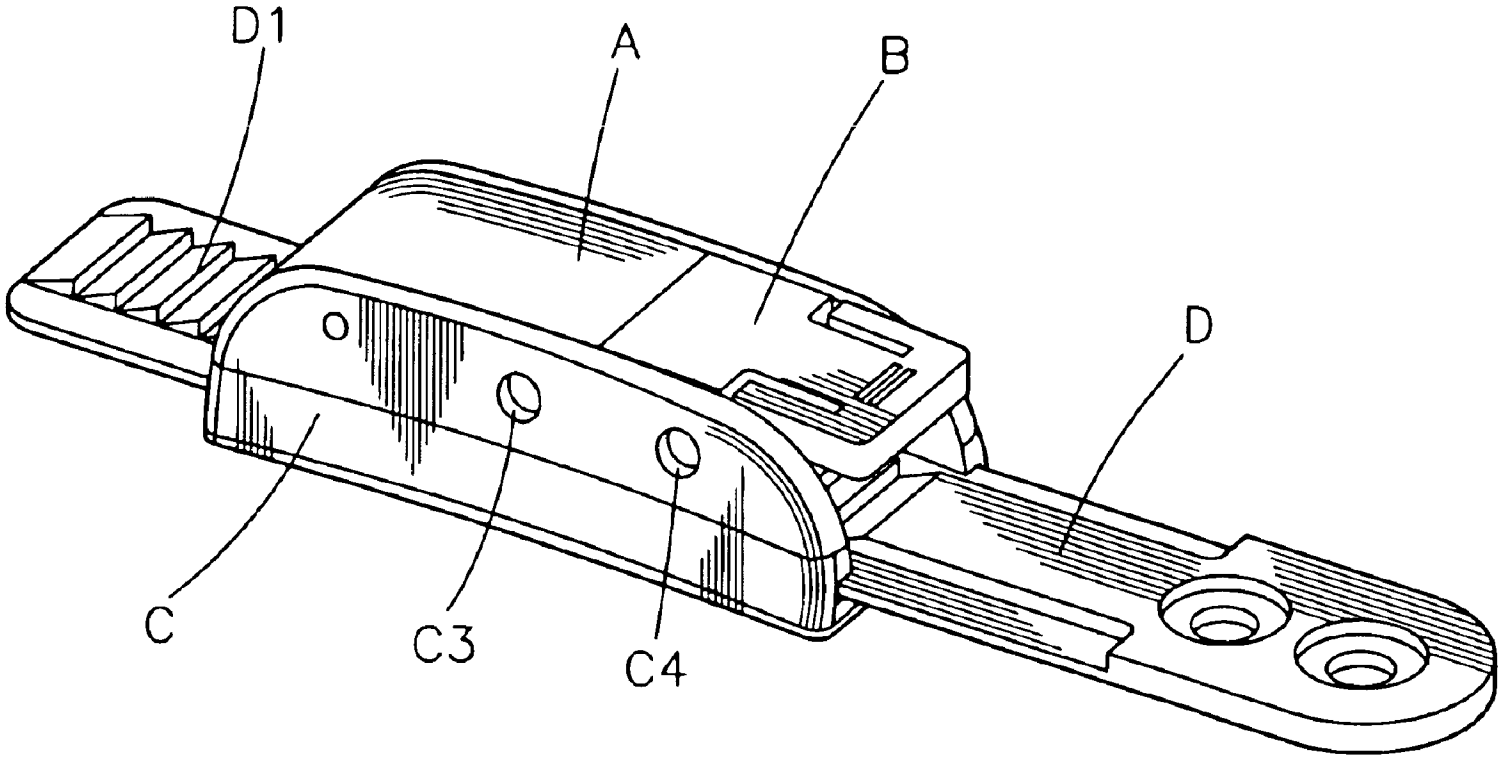
PRIOR ART FIG. 8
FIG. 8 is the elevational view of the conventional buckle.
Figure 9:
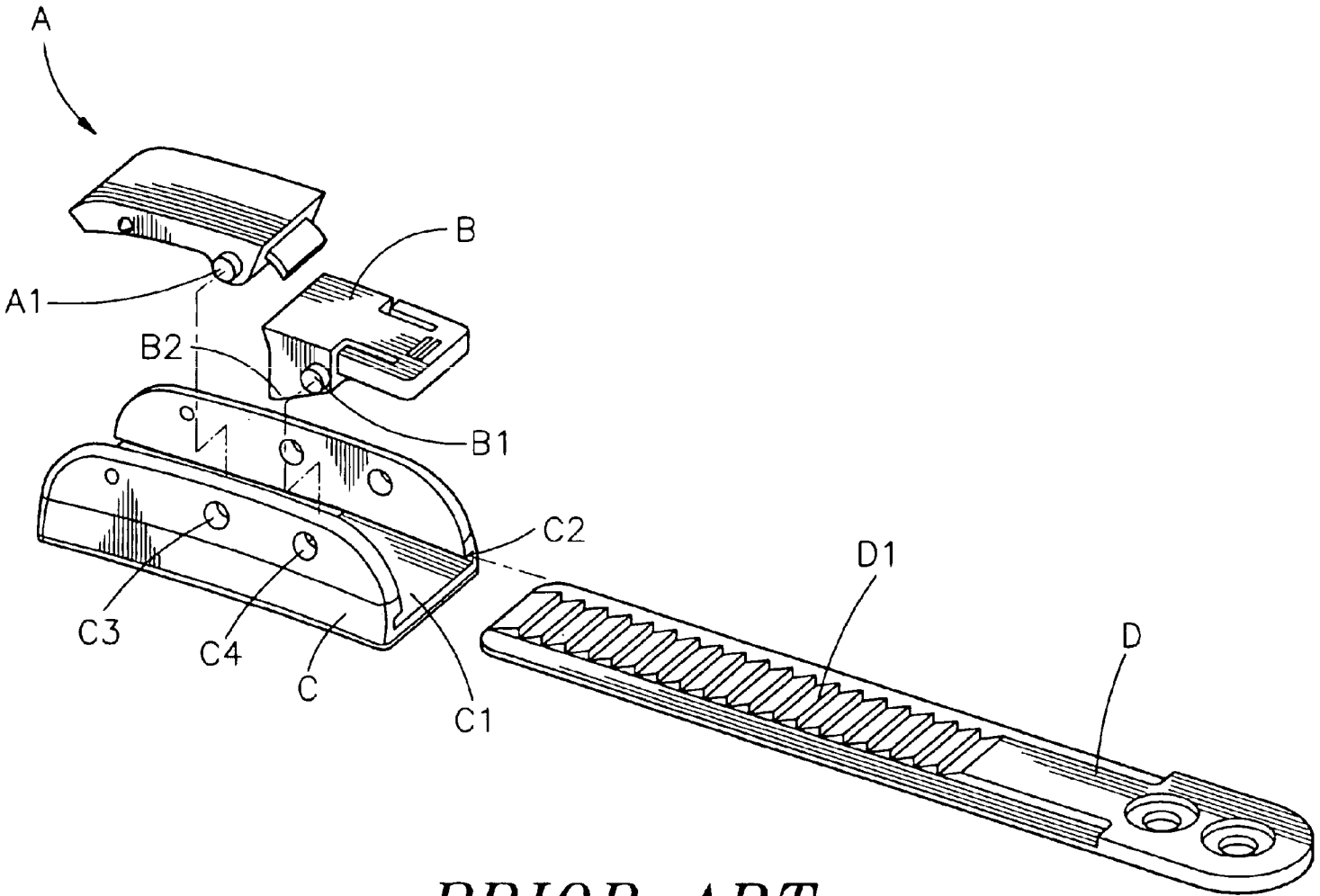
PRIOR ART FIG. 9
FIG. 9 is the explored view of the conventional buckle.

Now referring to FIGS. 4, 5 and 6, the exploded side view of the adjustment belt and the base, the side view of the fine adjustment handle according a preferred embodiment of the present invention, and the side view of the adjustable sliding belt during the operation are illustrated. To apply the present invention, the adjustment belt 4 faced to the through channel 31 of the base 3, meanwhile, the buckling portion 12 of the releasing plate 1 is fitted into the space between any two protruded gears 41 of the adjustment belt 4. When the user wishes to adjust the position of the adjustment belt 4 (referring to FIG. 4), the user can move the fine adjustment handle 2 along the reverse clock direction along with the axles 22 formed on the two sides of the fine adjustment handle 2 as the axis. Thus the vertical face between any two of the protruded gears 41 can be pushed by the resilient supporting plate 23 of the fine adjustment handle 2 for further moving the adjustment belt 4 forward through the distance of any one protruded gear 41, then move the fine adjustment handle 2 along the clock-wise direction to make the arched face of the resilient supporting plate 23 to come in contact with the slope of the protruded gear 41 which will resiliently deform and then return to the original position. Additionally, the two protruded points 21 formed at the outer side can be pressed into the two securing holes 32 of the base 3 for positioning, meanwhile, the handling portion 25 of the fine adjustment handle 2 is made to lean against the arch portion 36 of the base 3. When the user wishes to pull out the adjustment belt 4, as shown in FIG. 7, the user needs to just press the outer part of the unsupported portion of the releasing plate 1. In doing so, the axle 11 of the releasing plate 1 will move axially making the buckling portion 12 of the releasing plate 1 to move upwardly to escape from the space between the two protruded gears 41 of the adjustment belt 4. Accordingly, the user can easily move or pull out the adjustment belt 4. Besides, when pressing the releasing plate 1, the two resilient plates 13 can resiliently deform by supporting against the supporting block 35 of the base 3, so the user can elastically move or pull out the adjustment belt 4 due to the elasticity of the two resilient plates 13, and as well, the releasing plate 1 will return to the original position, that is, the position before being pressed.

Further referring to FIG. 7, the side view of the motion of the releasing plate of the present invention. As shown in FIG. 7, the releasing plate 1 and the fine adjustment handle 2 are set at the same side of the base 3, thus the overall space occupation can be substantially smaller, and the user only needs to use one hand to move the releasing plate 1 and press the fine adjustment handle 2. The releasing plate 1 and the fine adjustment handle 2 are operative in opposite direction, and the releasing plate 1 is positioned in the receiving hole 24 of the fine adjustment handle 2. Therefore, when the fine adjustment handle 2 is idle, the fine adjustment handle 2 can effectively protect the releasing plate 1 from being pressed by any external force, and therefore the adjustment belt 4 will not accidentally come loose from the base 3. The fine adjustable sliding buckle of the present invention substantially has the practical useful features, such as easy and safe operation, and smaller space occupation.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A fine adjustment sliding buckle, comprising:

a base, comprising two pairs of axial holes on two sides and a through channel on a bottom side between said two sides thereof;

a releasing plate, having axles, positioned in said base, wherein said axles on two sides of said releasing plate respectively have a resilient plate extending backward, and wherein when said releasing plate is positioned in said base, said resilient plate is supported against a surface of a supporting block;

a fine adjustment handle, having a receiving hole formed a surface thereof, said fine adjustment handle having axles, wherein said receiving hole is for placing said releasing plate, wherein said two pairs of axial holes of the base is for fitting said respective axles of said releasing plate and fine adjustment handle, and wherein at two sides of said fine adjustment handle and said releasing plate are said respective axles for fitting into said axial holes at the corresponding side of said base and the fine adjustment handle has a handling portion for supporting against a top face of said two sides of base; and an adjustment belt, positioned in the through channel of the base.

2. The fine adjustment sliding buckle according to claim 1, wherein said fine adjustment handle has a protruded point formed respectively on said two sides close to said axles for buckling into a corresponding securing hole of said base for positioning while closing.

3. The fine adjustment sliding buckle according to claim 1, wherein two sidewalls of said base has an arch portion at a top face of a side, the shape of said arch portion is formed to correspond to an arched bottom face of said handling portion of said fine adjustment handle.

* * * * *